United States Patent [19]

Wright et al.

[11] Patent Number: 4,927,553

[45] Date of Patent: May 22, 1990

[54] HAZE-FREE BORONATED ANTIOXIDANT

[75] Inventors: William E. Wright, Bryan T. Davis, both of Baton Rouge, La.; Donald S. Matteson, Moscow, Id.; Gordon G. Knapp, Baton Rouge, La.

[73] Assignee: Ethyl Corporation, Richmond, Va.

[21] Appl. No.: 492,354

[22] Filed: May 6, 1983

[51] Int. Cl.[5] ..... C10M 141/02

[52] U.S. Cl. ..... 252/49.6; 252/400.41; 252/407

[58] Field of Search ..... 252/32.7 E, 52 R, 49.6, 252/51.5 R, 400, 407

[56] References Cited

U.S. PATENT DOCUMENTS

| | | | |
|---|---|---|---|
| 2,831,817 | 4/1958 | Ecke et al. | 252/52 R |
| 3,014,061 | 12/1961 | Trish | 260/462 |
| 3,356,707 | 12/1967 | Henkamp | 252/49.6 |
| 3,649,538 | 3/1972 | Holten | 252/52 R |
| 4,231,883 | 11/1980 | Malec | 252/51.5 R |
| 4,331,222 | 5/1982 | Liston et al. | 252/52 R |

*Primary Examiner*—Jacqueline V. Howard

*Attorney, Agent, or Firm*—Joseph D. Odenweller

[57] ABSTRACT

An additive composition of boronated phenolic antioxidant and anti-haze diol capable of complexing with boric acid as well as organic material protected by the additive composition. A hydrolytically stable additive composition comprising a boronated phenolic antioxidant and a diol member capable of reacting with boric acid formed as a hydrolysis product to form a stable ring structure soluble in a substrate. The additive composition prevents or cures a haze caused by hydrolysis.

3 Claims, No Drawings

HAZE-FREE BORONATED ANTIOXIDANT

CROSS-REFERENCES TO RELATED APPLICATIONS

This application is an improvement for a class of compounds including those disclosed as new in U.S. Pat. application Ser. No. 360,781, filed Mar. 22, 1982, in the name of William E. Wright, and is commonly assigned. This application is also related to U.S. Pat. application Ser. No. 440,878, filed Nov. 12, 1982, in the names of William E. Wright et al. which is also commonly assigned.

BACKGROUND OF THE INVENTION

I. Field of the Invention

This invention relates to boronated phenolic antioxidants, coadditives, and haze-forming problems solved by coadditives. This invention relates in particular to the prevention and/or correction of a haze or film in a boronated phenolic antioxidant and organic materials containing the same with certain hydrocarbon diols.

II. Description of the Prior Art

Various boronated phenolics are well known in the art, including large molecular phenolics incorporating the moiety, 2,6- di-tert-butylphenol and the like. Various hydrocarbon diols are generally known in the chemical arts for various purposes.

SUMMARY OF THE INVENTION

We have found that various boronated phenolic antioxidants are subject to hydrolysis, some more so than others, if left exposed to the atmosphere. Moisture is responsible for the formation of boric acid and/or similar hydrolysis products which appear as a haze in or film on the antioxidant. In the case of organic material with the antioxidant therein, the hydrolysis product appears as a haze or cloudiness. This is unsuitable for some applications. As used herein, boric acid means generally the compound $B(OH)_3$ (or $H_3BO_3$) but should also be interpreted to include related hydrolysis products which may be produced in the manner of boric acid or along with boric acid depending upon the antioxidant used and which present themselves as a haze or film subject to being cured by the present invention.

We have now discovered that the haze problem can be cured by incorporation of certain hydrocarbon diols. Thus, the invention is a hydrolytically stable additive composition comprising a boronated phenolic antioxidant and a diol member selected from the group consisting of:

(a) diols of structure I:

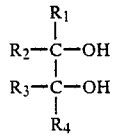

(I)

wherein all of $R_1$, $R_2$, $R_3$, and $R_4$ separately are independently selected H alkyl, cycloalkyl, aryl, aralkyl, or alkaryl or any two or more of $R_1$, $R_2$, $R_3$, and $R_4$ together with or without one or both of the carbon atoms form an alicyclic or aromatic ring with the two OH groups in a cis position; and (b) tertiary amine diols having attached to the nitrogen atom one fatty alkyl group of twelve to eighteen carbon atoms and either two or more polyoxyethylene groups or two 2-hydroxyethyl groups.

The invention is also a hyrolytically stable additive composition comprising a boronated phenolic antioixidant subject to hydrolysis in the presence of moisture so as to produce boric acid presenting as a haze in or film on said antioixidant and a diol reactive with the boric acid to form a stable ring structure III:

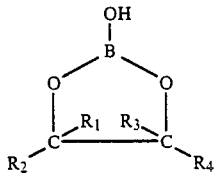

(III)

where $R_1$, $R_2$, $R_3$, and $R_4$ are independently selected alkyl, cycloalkyl, aryl, aralkyl, or alkaryl.

The invention is also organic material normally susceptible to gradual degradation in the presence of oxygen, containing an antioxidant amount of a boronated phenolic antioxidant subject to hydrolysis in the presence of moisture so as to produce boric acid appearing as a haze and a hydrocarbon diol soluble in the organic material and reactive with the boric acid to form a stable ring compound soluble in the organic material.

DESCRIPTION OF THE PREFERRED EMBODIMENT

A preferred embodiment of this invention is a boronated phenolic antioxidant having improved hydrolytic stability and being made haze-free/film-free by incorporation into the antioxidant of about 0.5–25 weight percent of a diol reactive with boric acid to form a stable five-member ring of structure III:

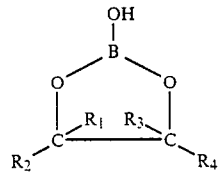

(III)

where $R_1$, $R_2$, $R_3$, and $R_4$ are independently selected alkyl, cycloalkyl, aryl, aralkyl, or alkaryl, $R_1$, $R_2$, $R_3$, and $R_4$ are preferably alkyl, more preferably methyl. Suitable substituents for the R groups are methyl, ethyl, propyl, tert-butyl, sec-butyl, and the like; cyclopentyl, cyclohexyl, cyclooctyl, and the like; phenyl, benzyl, and the like. The reaction mechanism to form such products is believed to be:

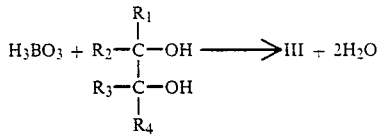

Any two of the "R" groups in the diol of structure I may together form a ring, with or without one or both of the carbon atoms in structure I. Thus, 1,2-dimethyl-1,2-cyclohexanediol is suitable since $R_1$ and $R_4$ are methyl, and $R_2$ and $R_3$ together with both carbons form a saturated cyclohexane ring. Also, suitable are compounds where only one of the carbon atoms is incorporated into the ring and where neither carbon atom is incorporated but two or more R's form an aromatic ring. It should be noted that, so long as a reaction product or complex is stable and soluble in the boronated antioxidant or stable and soluble in a protected substrate organic material, a diol is suitable, even where $R_1$ and $R_2$ may together form a ring and similarly for $R_3$ and $R_4$ or $R_1$ and $R_3$. We have found that diols having all R substituents other than H are effective. Preferably, the R's are alkyls, more preferably methyls. This supports the formation of stable ring structures. Thus, open chain hydrocarbon diols are effective if the ring structure of the boric acid reaction product is stabilized by substituents. In accordance with the above, we have found that cyclic hydrocarbon diols with the hydroxyl groups on adjacent carbon atoms should preferably have the hydroxy groups on the same side of the ring which may be called "cis" as opposed to "trans" for hydroxy groups on spatially opposite sides of the plane of the ring.

For example, a commercially available 1,2-cyclohexane diol which was formed by a process resulting in a mixture including a large portion of trans configuration 1,2-cyclohexane diol was only minimally effective according to the invention.

A preferred group of diols are those of structure I formed by the reductive coupling of ketones of structure II:

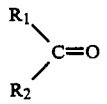

(II)

where $R_1$ and $R_2$ are alkyl, cycloalkyl, aralkyl, alkaryl, or together form a ring. In such diols, $R_1=R_3$ and $R_2=R_4$. A preferred ketone is acetone. Other suitable ketones include methyl ethyl ketone, methyl isobutyl ketone, acetophenone, and methyl cyclohexyl ketone. Electrochemical reduction is also suitable.

Suitable coupling agents are sodium, sodium amalgam, aluminum amalgam, magnesium, other metals, and various reductive coupling agents known in the art.

Pinacol, which may be formed by the reductive coupling of acetone is the most preferred diol hydrocarbon of the invention. Another highly preferred diol is pinane diol which has two hydroxy groups locked into a cis position as explained above. The cis-pinane diol may be prepared by oxidation of alpha pinene with agents like trimethylamine oxide dihydrate using a catalyst, for example oxmium tetroxide.

Another class of preferred hydrocarbon diols are the tertiary amine diols having attached to the nitrogen atom one fatty alkyl group of twelve to eighteen carbon atoms and either two or more polyoxyethylene groups or two 2-hydroxyethyl groups. Highly preferred are the cocoamines (twelve carbon alkyl group), such as bis(2-hydroxyethyl)cocoamine and polyoxyethylene (5) cocoamine. These two diols are available commercially from Armak Company as Ethomeen® C/12 and C/15 polyethoxylated amines, respectively. Other suitable tertiary amine diols are described in the Armak Company 1975 booklet, Chemicals for Industry.

The boronated phenolics of the invention are diverse. They include but are not limited to products obtained by reaction between a hindered phenolic compound and a completely esterified symmetrical oxy acid of boron whose esterifying radicals are derived from a monohydric alcohol and having discrete monovalent hydrocarbon ester groups. The dinuclear phenolics used to obtain these reaction products include 1,1-bis-(3,5-di-tert-butyl-4-hydroxphenyl)methane; 1,1-bis-(2-hydroxy-3-tert-butyl-5-methylphenyl)methane; 1,1-bis-(3,5-di-tert-butyl-4-hydroxyphenyl)phenylmethane; 3,3'-di-(1-ethylallyl)4,4'-di-hydroxydiphenyl; 1,10-di-(3-sec-amyl-2-hydroxyphenyl)octadecane; 2,2'-bis-[3-(1-phenyl-1-ethyl)-4-hydroxyphenyl]propane; 4,4'-isopropylidene-di-(2-isopropylphenyl); 3,5,5'-tridodecyl-3'-ethyl-4,4'-dihydroxydiphenyl; 3,3',5,5'-tetra-tert-butyl-4,4'-dihydroxypenyl; 2,2-bis-(2-hydroxy-3-tert-butyl-5-methoxyphenyl)-propane; 1,1-bis-4-hydroxy-3,5-di-tert-butylphenyl)methane; 3,3'-di-cyclohexyl-4,4'-di-hydroxydiphenyl; 2,15-di-(4-isopropyl-3-hydroxyphenyl)-hexadecane; 3-isopropyl-4,4'-hydroxydiphenyl; 4,4'-benzylidene-di-(2-isopropylphenyl); and numerous similar others. The boron esters used to obtain these products include isopropyl metaborate, hexyl metaborate trimer, 2-ethoxy-ethyl metaborate trimer, tri-sec-butyl orthoborate, tri-n-hexyl orthoborate, diethylphenyl boronate, n-butyl-di-p-tolylborinate, tetra-n-hexyl pyroborate, methyl metaborate trimer, n-butyl polyborate, isopropyl metaborate trimer, n-butyl metaborate, methyl di-n-butylborinate, dibutyl dodecyl orthoborate, and many others.

The boronated phenolics of the invention also include the boron esters derived from boron acids selected from the group pyroboric, boronic, and borinic acids wherein an esterifying group is an alkylphenol. These include tri-(2,6-di-tert-butylphenyl)orthoborate; tri-(2,6-di-tert-amylphenyl)orthoborate; di-(2,6-di-tert-amylphenyl)-monoether orthoborate; mono-(2,6-di-tert-butylphenyl)dibutyl orthoborate; mono-(2,6-di-tert-butylphenyl)ethylene glycol orthoborate; tri-(2,6-di-tert-butylphenyl)trimeric metaborate; tri-(2,6-di-tert-heptylphenyl)trimeric metaborate; tetra-2,6-di-tert-decylphenyl)pyroborate; tetra-(2,6-di-tert-heptylphenyl)-pyroborate; di-(2,6-di-tert-butylphenyl)propylboronate; (2,6-di-tert-octylpehnyl)di-phenylborinate; as well as 2,6-di-tert-alkylphenyl glycol orthoborates; 4,4'-methylenebis-(2,6-di-tert-alkylphenyl)dialkyl orthoborate; 4,4'-methylenebis-(2,6-di-tert-alkylphenyl)glycol orthoborates; 2,6-di-tert-alkylpehnyl dialkyl orthoborates; 2,6-di-tert-alkylphenyl metaborates; 2,6-di-tert-alkylphenyl metaborates; di-(2,6-di-tert-alkylphenyl)alkyl orthoborates; and the like. These compounds may be prepared from (1) phenolics including 2,6-di-tert-butylphenol; methylenebis-(2,6-di-tert-butylphenol); 2-tert-butyl-6-tert-amylphenol; 2,6-diamylphenol; 1,1-bis-(3,5-di-tert-butyl-4-hydroxyphenyl)methane; and the like; and (2) boron compounds including tri-n-butyl orthoborate; orthoboric acid; bis-(1,1,3-trimethyltrimethylene)-pyroborate; isopropyl-(2-methyl-2,4-pentylene)orthoborate; metaboric acid; isopropyl metaborate; butyl borinic acid; dibutyl monochloroborinate; tetraalkylpyroborates; isopropylmetaborate trimer, and the like.

The boronated products of the invention include borate esters of wax alkylated phenol, wax alkylated naphthol, wax alkylated cresol, cetylphenol, octadecylphenol, di-tert-octylphenol, isohexadecylphenol, and $C_{16-20}$ branched chain alkylpehnols. These esters are usually obtained by reaction with boric acid.

Also included in the invention are the 2,6-dialkyl alkylphenyl dialkyl borates such as 2,6-di-tert-butylphenyl-di-n-butyl orthoborate.

Additional boronated phenolics aided by the coadditives detailed below include the borates disclosed by Washburn et al. in U.S. Pat. No. 3,347,793 and by Hunter et. al. in U.S. Pat. No. 3,359,298, which are hereby incorporated herein by reference in their entirety.

The boronated phenolics of U.S. Pat. Application Ser. No. 360,781, filed Mar. 22, 1982 are highly preferred antioxidants of this invention. The most highly preferred boronated phenolic is one having about 0–50 weight percent 4,4'-methylenebis(2,6-di-tert-butylphenol), about 25–75 weight percent 4,4'-methylenebis(2,6-di-tert-butylphenol)mono(di-sec-butyl orthoborate), and about 10–75 weight percent 4,4'-methylenebis(2,6-di-tert-butylphenol)-di-(di-sec-butyl orthoborate). The most highly preferred boronated phenolic antioxidants protected by the diols of the invention may be prepared by a process comprising reacting at elevated temperature (a) one mole part of 4,4'-methylenebis(2,6-di-tert-butylphenol) and (b) 0.5–5.0 mole parts of a tri-sec-alkyl orthoborate wherein the sec-alkyl group contains 4–12 carbon atoms.

The mole ratio of tri-sec-alkyl orthoborate to 4,4'-methylenebis-(2,6-di-tert-butyl phenol) can vary over a wide range. A useful range is about 0.5–6 moles of tri-sec-alkyl orthoborate per mole of 4,4'-methylene-bis-(2,6-di-tert-butylphenol. A more preferred range is about 1-3 to 1.

The antioxidants are made by forming a reaction mixture of the tri-sec-alkyl orthoborate and 4,4'-methylenebis-(2,6-di-tert-butyl phenol) and heating this mixture while distilling out displaced sec-alkanol.

The reaction should be conducted at a temperature high enough to cause the phenol hydroxyl to displace a sec-alkyl group from the orthoborate ester and to cause the displaced sec-alcohol to distill out but not so high as to cause decomposition of the reactants or products. A useful temperature range in which to experiment is from about 150–300° C. When using tri-sec-butyl orthoborate, the preferred temperature range is about 200–275° C.

The transesterification reaction can be catalyzed by a small amount of an acidic material. This include sulfuric acid, phosphoric acid, methane sulfonic acid, p-toluene sulfonic acid, and the like. The preferred catalysts are the lower fatty acids such as formic acid, acetic acid, propionic acid, butyric acid, and the like. The most preferred catalyst is acetic acid.

Only a small catalytic amount of catalyst is required. A useful catalyst range is about 0.02–0.2 weight percent based upon total reaction mass.

The principal components in the reaction mixture are 4,4'-methylene-bis-(2,6-di-tert-butyl phenol) mono-(di-sec-$C_{4-12}$ alkyl orthoborate) ester and 4,4'-methylenebis-(2,6-di-tert-butyl phenol) di-(di-sec-$C_{4-12}$ alkyl orthoborate) ester together with varied amounts of unreacted 4,4'-methylene-bis-(2,6-di-tert-butyl phenol). Analysis of products made from tri-sec-butyl orthoborate show them to contain about 0–50 weight percent 4,4'-methylene-bis-(2,6-di-tert-butyl phenol), 25-75 weight percent 4,4'-methylenebis-(2,6-di-tert-butyl phenol) mono-(di-sec-butyl orthoborate) ester and 10–75 weight percent 4,4'-methylenebis-(2,6-di-tert-butyl phenol) di-(di-sec-butyl orthoborate) ester.

In order to meet emission standards most present-day automobiles in the U.S. include a catalytic converter in the exhaust system to lower hydrocarbon and carbon monoxide content of engine exhaust gas. Such catalysts are expected to remain effective for at least 50,000 miles. Certain chemicals in the exhaust gas can cause premature deactivation of the catalyst. One such chemical is lead or lead compounds in the exhaust gas. To prevent this, catalyst-equipped cars are required to operate on lead-free gasoline.

It has been found that additives in the crankcase lubricating oil can also find their way into the exhaust gas. One such additive is zinc dialkyldithiophosphate (ZDDP). These additives cause phosphorus compounds to be emitted in the engine exhaust. Such phosphorus compounds can cause catalyst deterioration. Thus far, it has not been found practical to remove ZDDP from the crankcase oil because ZDDP is required both for antiwear and antioxidant protection. The amount of ZDDP in the oil required to provide adequate protection is generally an amount which is sufficient to impart at least 0.14 weight percent phosphorus to the oil. At this concentration, catalyst deactivation due to phosphorus can occur. There is a greater incentive to decrease the amount of phosphorus in motor oil while at the same time providing an adequate level of antiwear and antioxidant protection for the engine.

In another preferred embodiment of the invention the amount of ZDDP in crankcase lubricating oil formulated for use to in the crankcase of an internal combustion engine is reduced to a level which provides a low phosphorus lubricating oil composition containing only about 0.05-0.11 weight percent phosphorus. The low phosphorus formulation is made possible by including in the oil an antioxidant amount of the previously-described reaction product of 4,4'-methylenebis-(2,6-di-tert-butyl phenol) and a tri-sec-$C_{4-12}$ alkyl orthoborate. In this embodiment the most preferred additive is the reaction product of 4,4'-methylene-bis-(2,6-di-tert-butyl phenol) and tri-sec-butyl) orthoborate.

The following nine examples show how the highly preferred boronated phenolic antioxidants of U.S. Pat. Application Ser. No. 360,781, filed Mar. 22, 1982, are prepared:

EXAMPLE 1

In a reaction vessel was placed 127 grams (0.3 moles) of 4,4'-methylenebis(2,6-di-tert-butylphenol) (or 4,4'-MBTP) and 234 grams (1.02 moles) of tri-sec-butyl orthoborate. This mixture was stirred and heated under nitrogen for 26 hours to distill out displaced sec-butanol while gradually increasing the temperature from 203° C. to 261° C. Following this the reactant product was cooled and then stripped at reduced pressure (3.0 to 0.3 mm Hg) while heating the reaction mixture to 207° C. This removed residual alcohol and any unreacted orthoborate ester. The residual product was analyzed and found to contain 1.7 weight percent boron.

EXAMPLE 2

In a reaction vessel was placed 123 grams (0.535 moles)tri-sec-butyl orthoborate and 113.4 grams (0.267 moles) of 4,4'-MBTP. The mixture was stirred under nitrogen for 21 hours while gradually heating from 213° C. to 256° C. to displace sec-butanol. Volatiles were then stripped from the product by reducing the pressure to 8 mm Hg at 100° C. pot temperature and gradually heating to 202° C. pot temperature at 0.1 mm Hg pressure. The product was analyzed and found to contain 1.8 weight percent boron. The product was further analyzed using high pressure liquid chromatography (HPLC) and found to contain 18 weight percent 4,4'-MBTP, 51 weight percent mono-(di-sec-butyl orthoborate) ester of 4,4'-MBTP and 24 weight percent di-(di-sec-butyl orthoborate) ester of 4,4'-MBTP. The remaining components were not identified.

EXAMPLE 3

In a reaction vessel was placed 2000 grams (8.7 moles) tri-sec-butyl orthoborate and 1847 grams 4,4'-MBTP. The mixture was stirred under nitrogen for 21 hours while gradually heating from 110° C. to 228° C. while distilling out sec-butanol. Residual volatile material was then stripped from the product by heating from 127° C. at 3.0 mm Hg to 202° C. at 1.6 mm Hg. over a five hour period. The product contained 1.4 weight percent boron and analyzed by HPLC to contain 29 weight percent 4,4'-MBTP, 52 weight percent mono-(di-sec-butyl orthoborate) ester of 4,4'-MBTP and 20 weight percent di-(di-sec-butyl orthoborate) ester of 4,4'-MBTP.

EXAMPLE 4

In a reaction vessel was placed 140 grams (0.33 moles) of 4,4'-MBTP and 77 grams (0.33 moles) tri-sec-butyl orthoborate. The mixture was stirred and heated under nitrogen for 8 hours at temperature from 217° C. up to a final temperature of 290° C. It was then vacuum-stripped at 0.3 mm Hg for one hour at a pot temperature of 182°-205° C. The product analyzed 1.4 weight percent boron and by HPLC contained 26 weight percent 4,4'-MBTP, 49 weight percent mono-(di-sec-butyl orthoborate)ester of 4,4'-MBTP and 17 weight percent di-(di-sec-butyl orthoborate) ester of 4,4'-MBTP.

EXAMPLE 5

In a reaction vessel was placed 140 grams (0.33 moles) of 4,4'-MBTP and 154 grams (0.66 moles) tri-sec-butyl orthoborate. The mixture was stirred under nitrogen and heated at about 250° C. for seven hours while distilling out sec-butanol. Residual volatiles were then stripped at 0.3 mm Hg while heating from 155 to 225° C. over a 0.7 hour period. The product analyzed 1.7 weight percent boron and contained 15 weight percent 4,4'-MBTP, 46 weight percent mono-di-sec-butyl orthoborate) ester of 4,4'-MBTP and 23 weight percent di-(di-sec-butyl orthoborate) ester of 4,4'-MBTP.

EXAMPLE 6

In a reaction vessel was placed 140 grams of 4,4'-MBTP and 77 grams tri-sec-butyl orthoborate. This was stirred and heated under nitrogen for 6 hours at 250-260° C. while distilling sec-butanol. It was then stripped at 0.3 mm Hg for 1.2 hours while heating from 113° C. to 235° C. The product analyzed 1.3 weight percent boron and contained 25 weight percent 4,4'-MBTP, 46 weight percent mono-(di-sec-butyl orthoborate) ester of 4,4'-MBTP and 12 weight percent di-(di-sec-butyl orthoborate) ester of 4,4'-MBTP.

EXAMPLE 7

In a reaction vessel was placed 100 grams 4,4'-MBTP, 82 grams tri-sec-butyl orthoborate and three drops of acetic acid. The mixture was stirred under nitrogen for 2.5 hours at 230°-270° C. while distilling out sec-butanol. The product was then stripped at 0.3 mm Hg for 0.7 hours while heating from 90° to 195° C. The product analyzed 1.6 weight percent boron.

EXAMPLE 6

This example was conducted the same as the previous example except the reaction time was reduced to two hours while heating from 200° to 260° C.

EXAMPLE 9

In a reaction vessel was placed 100 grams (0.24 moles) 4,4'-MBTP, 109 grams (0.47 moles) tri-sec-butyl orthoborate and 0.04 weight percent acetic acid catalyst. The mixture was stirred under nitrogen for 3 hours while heating from 200° to 265° C. and distilling out sec-butanol. It was then vacuum-stripped at 140°-170° C. at 0.3 mm Hg. It analyzed 2.1 weight percent boron and contained 4 percent 4,4'-MBTP, 35 percent 4,4'-MBTP mono-(di-sec-butyl orthoborate) ester and 58 percent 4,4'-MBTP di-(di-sec-butyl orthoborate) ester.

The following examples demonstrate the haze-free invention.

EXAMPLE 10

Two open bottles each containing a 40 gram portion of a Sun Oil company lubricating base stock containing 1.0 weight percent of the most highly preferred boronated phenolic antioxidant mixture (described above) were subjected to a warm, humid atmosphere for several weeks (43° C., 100% relative humidity). Both became very cloudy due to hydrolysis and a white sediment settled on the bottom of the bottle. To one of the portions was added 0.04 gram pinane diol (cis configuration). After stirring both portions for one hour at 25° C. the two portions were left open and allowed to settle over the weekend. The portion containing the pinane diol was clear and bright; the other remained cloudy.

EXAMPLE 11

About 0.3 gram cis pinane diol was mixed into a 20 gram portion of a 50% blend of the most highly preferred antioxidant in an Exxon solvent neutral oil (100 N). This and a like sample without diol were exposed for a few days to the conditions of heat and humidity described in Example 10. The sample without diol had become very cloudy whereas the sample with pinane diol appeared only slightly hazy. Further addition of pinane diol up to 1.0 gram total, to the slightly hazy sample did not completely disperse the haze. The same experiment was carried out for pinacol and Ethomeen® C/12 tertiary amine diol with similarly good results. Note: In a follow-up experiment, three comparative samples, one without any diol, were inadvertently contaminated with liquid $H_2O$ and rust. No improvement could be determined.

EXAMPLE 12

To three 30 gram portions of a 50 percent blend of the most highly preferred boronated phenolic antioxidant of the invention in an Exxon solvent neutral oil (100 N), were added:

(a) 0.75 gram pinacol (b) 0.75 gram Armak Company's Ethomeen® C/12 tertiary amine (diol)

(c) 0.30 gram 3,5-di-tert-butyl catechol.

The addition of catechol in (c) was limited to 0.30 gram due to poor solubility. After two days exposure to heat and humidity as described in Example 10, a fourth 30 gram portion (d) of blend without any diol and portion (c) were very hazy. Portions (a) and (b) were very clear. After twenty six days exposure to heat and humidity, (a) and (b) were also very hazy.

EXAMPLE 13

Seven 20 gram portions of the blend described in Example 12 were combined with diols and exposed to warm humid air as described above. An eighth portion without any diol was treated similarly for comparison. The results are reported in Table 1 below:

TABLE 1

Anti-Haze Effect of Diols

| Diol | Concentration* Weight % | Effect |
|---|---|---|
| None | — | Haze within one day |
| Pinacol | 5 | Slightly cloudy within 17 days |
| " | 10 | Clear after 10 weeks |
| Ethomeen ® C/12 tertiary amine (diol) | 5 | Surface skin formed after 10 days |
| Ethomeen ® C/12 tertiary amine (diol) | 10 | Surface skin after several weeks |
| **Ethomeen ® C/12 C/15 tertiary amine (diol) | 5 | Heavy cloudiness after 17 days |
| **Ethomeen ® C/15 tertiary amine (diol) | 10 | Somewhat cloudy after 26 days |
| Pinane diol | 10 | Cloudy after 31 days |

*Relative to boronated phenolic antioxidant
**A pink coloration was observed on mixing.

While pinacol and pinane diol were completely miscible with the most highly preferred antioxidant of the invention, numerous other diols were found to be immiscible or otherwise incompatible with the neat antioxidant. The incompatible diols include 1,2-butanediol; 1,2-octanediol; 2-ethyl-2-methyl-1,3-propanediol; 1,2-cyclohexanediol (trans); 1,3-cyclohexanediol; 1,3-butanediol; 1,4-butanediol; 2,5-hexanediol; 1,10-decanediol. However, it is possible that some of these diols may be compatible and effective with other neat antioxidants or compositions of organic material containing the antioxidant.

The haze formed in boronated phenolic antioxidants can interfere with product handling.

The haze/film can interfere with product handling and/or incorporation of the boronated phenolic into a substrate material such as lubricating oil. Thus, the invention assists handling, permits long-term storage, and facilitates mixing of the boronated phenolic into an organic material substrate. For example, if a finished oil becomes cloudy, oil passageways and filters could become blocked leading to loss of lubrication.

The diols preventing haze/film may be incorporated into the boronated phenolics by various methods of mixing including the use of impellers or rotating mixing chambers. The diol is added in an amount effective to prevent formation of haze/film, depending upon the particular boronated phenolic and the diol selected. A suitable range is about 0.5 to 25 weight percent diol. About 1–15 weight percent diol, based on the weight of antioxidant, is preferred. Numerous materials have been tried without success in curing the haze problem. Many glycols and diols are ineffective because either they are not soluble in the antioxidant-protected substrate or they do not combine with boric acid hydrolysis product to form a stable complex/compound which does not itself form a haze or sediment. The diols of the invention may not be soluble in the boronated phenolic antioxidant but they must be capable of so mixing with the antioxidant that haze is prevented/corrected. In an organic material protected by the boronated phenolic antioxidant the diol must prevent-correct the haze from the hydrolysis product so as to form a complex or compound which does not itself appear as a haze, film, or sediment. More preferably, the compound or complex formed is soluble in the organic material.

Lubricating oils are a preferred class or organic materials protected by the invention. In general, the substrate organic materials protected by the haze-free boronated phenolics of the invention are those normally subject to gradual degradation in the presence of oxygen during use over an extended period. In other words, the organic compositions protected by the present haze-free antioxidants are the type in which the art recognizes the need for antioxidant protection and to which an antioxidant of some type is customarily added to obtain an extended service life. The oxidative degradation protected against is the slow gradual deterioration of the organic composition rather than, for example, combustion. In other words, the present haze-free antioxidants are not flame retarding additives or flame suppressing additives and the degradation protected against is not combustion but rather the gradual deterioration of the organic composition due to the effects of oxygen over an extended period of time.

Examples of organic materials in which the additives are useful include polymers, both homopolymers and copolymers, of olefinically unsaturated monomers, for example, polyolefins such as polyethylene, polypropylene, polybutadiene, and the like. Also, polyhalohydrocarbons such as polyvinyl chloride, polychloroprene, polyvinylidene chloride, polyfluoro olefins, and the like, are afforded stabilization. The additives provide antioxidant protection in natural and synthetic rubbers such as copolymers of olefinically unsaturated monomers including styrene-butadiene rubber (SBR rubber), ethylene-propylene copolymers, ethylene-propylene-diene terpolynmers such as the terpolymer of ethylene, propylene and cyclopentadiene or 1,4-cyclooctadiene, Polybutadiene rubbers such as cis-polybuta diene rubber are protected. Poly-2-chloro-1,3-butadiene (neoprene) and poly-2-methyl-1,3-butadiene (isoprene rubber) are stabilized by the present additives. Likewise, acrylonitrile-butadiene-styrene (ABS) resins are effectively stabilized. Ethylene vinyl acetate copolymers are protected, as are butenemethacrylate copolymers. Nitrogen-containing polymers such as polyurethanes, nitrile rubber, and lauryl acrylate-vinylpyrrolidone copolymers are effectively stabilized. Adhesive compositions such as solutions of polychloroprene (neoprene) in toluene are protected.

Fats and oils of animal and vegetable origin are protected against gradual deterioration. Examples of these are lard, beef tallow, coconut oil, safflower oil, castor oil, babassu oil, cottonseed oil, corn oil, rapeseed oil, tall oil and the like.

Petroleum oils and waxes such as solvent-refined mid-continent lubricating oil microcrystalline wax, and Gulf-coast lubricating oils are effectively stabilized.

Animal feeds such as ground corn, cracked wheat, oats, wheat germ, alfalfa, and the like are protected by mixing a small but effective amount of the present additive with these products. Vitamin extracts, especially the fat-soluble vitamins such as Vitamin A, B, D, E and C, are effectively stabilized against degradation.

The additives are useful in foamed plastics such as expanded polystyrene, polyurethane foams, and the various foamed rubbers, alkyd resins such as short oil terephthalic acid-glycerol-linseed oil resins, and typical long oil resins of trimellitic acid-clycol-tung oil resins including epoxidemodified alkyd resins. Epoxy resins themselves such as isopropylidenebisphenolepichlorohydrin epoxy resins are stabilized against degradation.

Hydrocarbons such as gasoline, kerosene, diesel fuel, fuel oil, furnace oil, and jet fuel are effectively protected. Likewise, synthetic hydrocarbon lubricants, for example α-decene trimer, polybutene lubricants di- and tri-$C_{12-30}$ alkylated benzene and naphthalene synthetic lubricants are likewise protected.

Organometallics such as tetraethyllead, tetramethyllead, tetravinyllead, ferrocene, methyl ferrocene, cyclopentadienyl manganese tricarbonyl, methyl cyclopentadienyl manganese tricarbonyl, cyclopentadienyl nickel nitrosyl, and the like, are effectively protected against oxidative degradation. Silicone oils and greases are also protected.

Synthetic ester lubricants such as those used in turbines and turbojet engines are given a high degree of stabilization. Typical synthetic ester lubricants include di-2-ethylhexyl sebacate, trimethylolpropane tripelargonate, $C_{5-9}$ aliphatic monocarboxylic esters of pentaerythritol, complex esters formed by condensing under esterifying conditions, mixtures of polyols, polycarboxylic acids, and aliphatic monocarboxylic acids and/or monohydric alkanols. An example of these complex esters is the condensation product formed from adipic acid, ethyleneglycol and a mixture of $C_{5-9}$ aliphatic monocarboxylic acids. Plasticizers such as dioctyl phthalate are effectively protected. Heavy petroleum fraction such as tar and asphalt can also be protected should the need arise.

Polyamides such as adipic acid-1,6-diaminohexane condensates and poly-6-aminohexanoic acid (nylon) are effectively stabilized. Polyalkylene oxides such as copolymers of phenol with ethylene oxide or propylene oxide are stabilized. Polyphenyl ethers such as poly-2,6-dimethylphenyl ether formed by polymerization of 2,6-dimethylphenol using a copper-pyridine catalyst are stabilized. Polycarbonate plastics and other polyformaldehydes are also protected.

Linear polyesters such as phthalic anhydride-glycol condensates are given a high degree of protection. Other polyesters such as trimellitic acid-glycerol condensates are also protected. Polyacrylates such as polymethacrylate and polymethylmethacrylate are effectively stabilized. Polyacrylonitriles and copolymers of acrylonitriles with other olefinically unsaturated monomers such as methylmethacrylates are also effectively stabilized.

Polyurethanes formed from diisocyanates (e.g. toluene diisocyanate) and polyols and optionally polyamine modifiers are likewise protected against oxidative degradation.

The additives can be used to protect any of the many organic substrate to which an antioxidant is normally added. It can be used where economics permit to protect such substrates as asphalt, paper, flurocarbons, such as teflon, polyvinyl acetate, polyvinylidene chloride, coumaroneindene resins, polyvinyl ethers, polyvinylidene bromide, polyvinyl bromide, acrylonitrilevinyl bromide copolymer, vinyl butural resins, silicones such as dimethylsilicone lubricants, phosphate lubricants such as tricresylphosphate, and the like.

The additives are incorporated into the organic substrate in a small but effective amount so as to provide the required antioxidant protection. A useful range is from about 0.005 to about 10 weight percent, and a preferred range is from about 0.05 to 5 weight percent.

Methods of incorporating the additive into the substrate are well known. For example, if the substrate is liquid the additive can be merely mixed into the substrate. Frequently the organic substrate is in solution and the additive is added to the solution and the solvent removed. Solid organic substrates can be merely sprayed with a solution of the additive in a volatile solvent. For example, stabilized grain products result from spraying the grain with a toluene solution of the additive. In the case of rubbery polymers the additive can be added following the polymerization stage by mixing it with the final emulsion or solution polymerization mixture and then coagulating or removing solvent to recover the stabilized polymer. It can also be added at the compounding stage by merely mixing the additive with the rubbery polymer in commercial mixing equipment such as a Banbury blender. In this manner, rubbery polymers such as styrene-butadiene rubber, cis-polybutadiene or isoprene polymers are blended with the antioxidant together with the other ingredients normally added such as carbon black, oil, sulfur, zinc oxide, stearic acid, vulcanization accelerators, and the like. Following mastication, the resultant mixture is fabricated and molded into a finished form and vulcanized.

The additives are especially useful in mineral oil or in synthetic oils of viscosity suitable for use in the crankcase of an internal combustion engine. Crankcase lubricating oils have a viscosity up to about 80 SUS at 210° F. Sometimes such motor oils are given a classification of both 0° and 210° F., such as SAE 10W 40 or SAE 5W 30.

Mineral oils include those of suitable viscosity refined from crude oil from all sources including Gulfcoast, midcontinent, Pennsylvania, California, Alaska, North Sea, and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl) adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 5–25 weight percent hydrogenated α-decene trimer with 75–95 weight percent 150 SUS (100° F.) mineral oil results in an excellent lubricant. Likewise, blends of about 5–25 weight percent di-(2-ethylhexyl) adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc di-(nonylphenyl)dithiophosphate is a typical aryl-type ZDDP. The amount of ZDDP used has imparted as much as 0.14 weight percent or more phosphorus to the oil which can damage exhaust gas catalysts. With the use of the present additives, the amount of ZDDP can be reduced to supply less than 0.11 weight percent phosphorus to the oil.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium petroleum sulfonate or alkaryl (e.g. alkylbenzene) sulfonate.

Viscosity index improvers can be included such as the polyalkyl-methacrylate type or the ethylene-propylene copolymer type. Likewise, styrene-diene VI improvers or styrene-acrylate copolymers can be used. Alkaline earth metal salts of phosphosulfurized polyisobutyene are useful.

The crankcase oils can also contain ashless dispersants such as the polyolefin-substituted succinamides and succinimides of ethylene polyamines such as t etraethylenepentamine. The polyolefin succinic substituent is preferably a polyisobutene group having a molecular weight of from about 800 to 5000. Such ashless dispersants are more fully described in U.S. Pat. No. 3,171,892 and U.S. Pat. No. 3,219,666 incorporated herein by reference.

Another useful class of ashless dispersants are the polyolefin succinic esters of mono- and polyhydroxyl alcohols containing 1 to about 40 carbon atoms. Such dispersants are described in U.S. Pat. No. 3,381,022 and U.S. Pat. No. 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5000. The preferred polyethylene polyamine is tetraethylene pentamine. Such Mannich ashless dispersants are more full described in U.S. Pat. No. 3,368,972; U.S. Pat. No. 3,413,347; U.S. Pat. No. 3,442,808; U.S. Pat. No. 3,448,047; U.S. Pat. No. 3,539,663; U.S. Pat. No. 3,591,598; U.S. Pat. No. 3,600,372; U.S. Pat. No. 3,634,515; U.S. Pat. No. 3,697,574; U.S. Pat. No. 3,703,536; U.S. Pat. No. 3,704,308; U.S. Pat. No. 3,725,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247 and U.S. Pat. No. 3,803,039.

The above Mannich dispersants react with boric acid to form boronated dispersants having improved corrosion properties.

We claim:

1. A hydrolytically stable additive composition comprising about 75–99.5 parts by weight of a boronated phenolic antioxidant which is a mixture of about 0–50 weight percent 4,4'methylenebis(2,6-di-tert-butylphenol); about 10–75 weight percent 4,4'-methylenebis(2,6-di-tert-butylphenol)-di-(di-sec-butyl orthoborate); and about 25–75 weight percent 4,4'-methylenebis(2,6-di-tert-butylphenol)-mono-(di-sec-butyl orthoborate), said boronated phenolic antioxidant being subject to hydrolysis in the presence of moisture and, to prevent or correct haze or film formation in said boronate phenolic antioxidant due to said hydrolysis, about 0.5–25 parts by weight of pinane diol or pinacol.

2. A lubricating oil composition containing an antioxidant amount of an additive of claim 1.

3. A lubricating oil composition of claim 2 comprising about 75–99.5 parts by weight of a boronated phenolic antioxidant which is a mixture of about 0–50 weight percent 4,4'-methylene-bis(2,6-di-tert-butylphenol); about 10–75 weight percent 4,4'-methylenebis(2,6-di-tert-butylpehnol)-di-(di-sec-butyl orthoborate); and about 25–75 weight percent 4,4'-methylenebis(2,6-di-tert-butylphenol)-mono-(di-sec-butyl orthoborate), said boronated phenolic antioxidant being subject to hydrolysis in the presence of moisture and, to prevent or correct haze or film formation in said boronate phenolic antioxidant due to said hydrolysis, about 0.5–25 parts by weight of pinacol.

* * * * *